US007158082B2

(12) United States Patent
Mierke et al.

(10) Patent No.: US 7,158,082 B2
(45) Date of Patent: Jan. 2, 2007

(54) LOW-HEIGHT DUAL OR MULTI-BAND ANTENNA, IN PARTICULAR FOR MOTOR VEHICLES

(75) Inventors: Frank Mierke, Rosenheim (DE); Peter Karl Prassmayer, Grosskarolinenfeld (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/521,094

(22) PCT Filed: Jun. 12, 2003

(86) PCT No.: PCT/EP03/06199

§ 371 (c)(1),
(2), (4) Date: Jul. 13, 2005

(87) PCT Pub. No.: WO2004/008573

PCT Pub. Date: Jan. 22, 2004

(65) Prior Publication Data

US 2006/0012524 A1 Jan. 19, 2006

(30) Foreign Application Priority Data

Jul. 15, 2002 (DE) ..... 102 31 961

(51) Int. Cl.
*H01Q 1/38* (2006.01)

(52) U.S. Cl. ..... 343/700 MS; 343/846

(58) Field of Classification Search ..... 343/700 MS, 343/829, 846

See application file for complete search history.

(56) References Cited

U.S. PATENT DOCUMENTS 4,162,499 A * 7/1979 Jones et al. ..... 343/700 MS
5,977,916 A 11/1999 Vannatta et al. ..... 343/702
6,310,586 B1 10/2001 Takahashi et al. ..... 343/872
6,456,243 B1 * 9/2002 Poilasne et al. ..... 343/700 MS
6,856,285 B1 * 2/2005 Bettin et al. ..... 343/700 MS

FOREIGN PATENT DOCUMENTS

DE 34 36 227 C2 4/1985

(Continued)

OTHER PUBLICATIONS

R. Johnson, "Antenna Engineering Handbook", 1993, McGraw-Hill, New York, USA, XP002256266, pp. 7-18.

(Continued)

*Primary Examiner*—Michael C. Wimer
(74) *Attorney, Agent, or Firm*—Nixon & Vanderhye PC

(57) ABSTRACT

The invention relates to an improved, low-height dual or multi-band antenna comprising surface transmitters, whose size varies in accordance with the frequency band to be transmitted. Said antenna is configured from a smaller surface transmitter that is located on top of a larger surface transmitter. The antenna is characterized by the following improved features: the dual or multi-band antenna is essentially configured as a one-piece punched and bent metal part; as a one-piece component, said antenna consists of at least two surface transmitters, which are electrically connected via a short-circuit; and at least the lowest surface transmitter for transmission in a lower frequency band and/or at least a surface transmitter that is lower than the surface transmitter for transmission in the highest frequency band have transmitter wings lying adjacent to their transmitter surface. When the antenna is viewed from above, the respective surface transmitter for transmission in a higher frequency band lies between the wings of said lower frequency band transmitters.

16 Claims, 13 Drawing Sheets

FOREIGN PATENT DOCUMENTS

Figure 1:
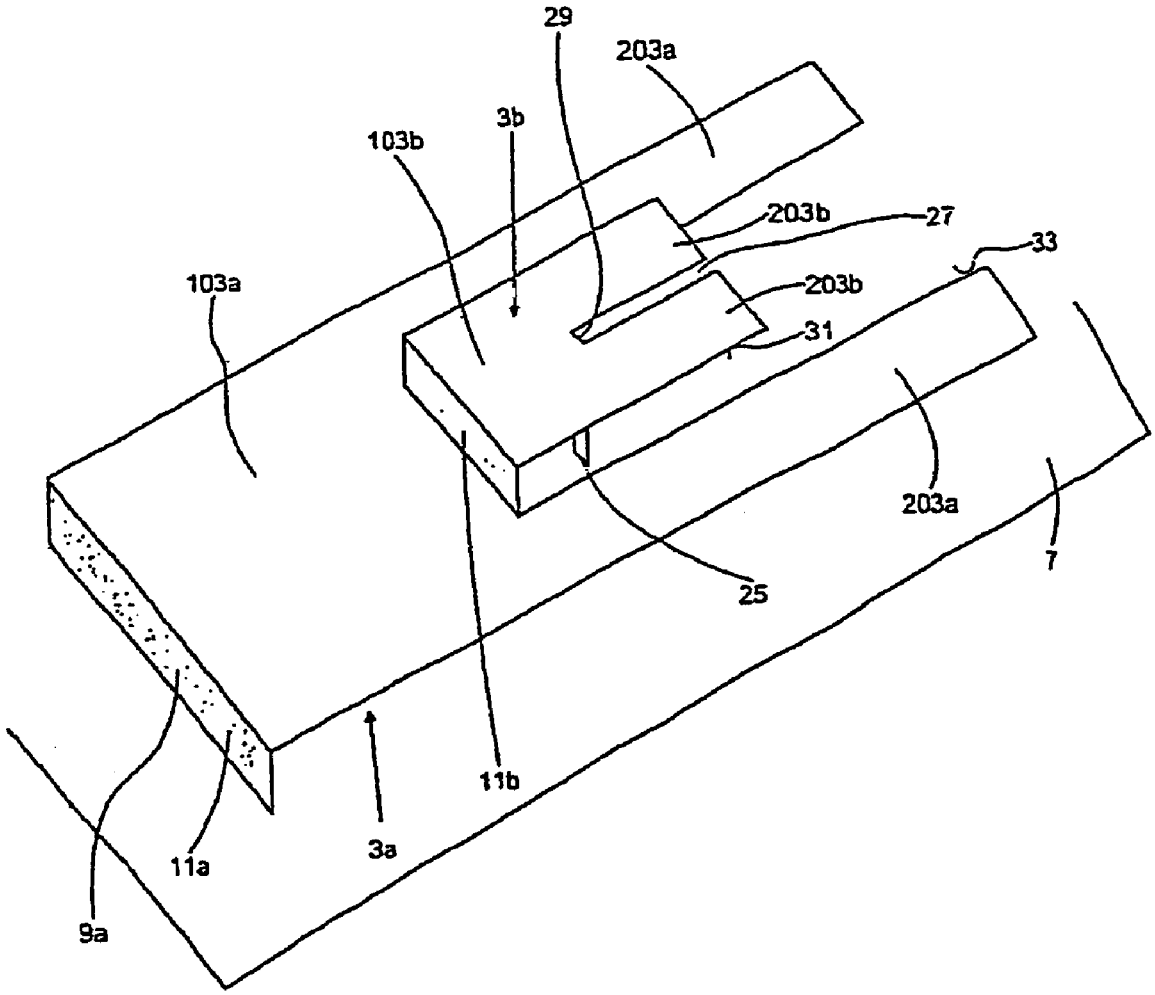

| | | | |
|---|---|---|---|
| DE | 195 12 003 | A1 | 10/1995 |
| DE | 199 29 689 | A1 | 1/2001 |
| EP | 0 537 548 | A1 | 4/1993 |
| EP | 0 604 338 | A1 | 6/1994 |
| EP | 0 777 295 | A2 | 6/1997 |
| EP | 0 871 238 | A2 | 3/1998 |

OTHER PUBLICATIONS

M. Tong et al., "Finite-Difference Time-Domain Analysis of a Stacked Dual-Frequency Microstrip Planar Inverted-F Antenna for Mobile Telephone Handsets", IEEE Transactions on Antennas and Propagation, IEEE Inc. New York, US, vol. 49, No. 3, Mar. 2001, pp. 367-376.

International Search Report.

* cited by examiner

LOW-HEIGHT DUAL OR MULTI-BAND ANTENNA, IN PARTICULAR FOR MOTOR VEHICLES

This application is the US national phase of international application PCT/EP03/06199 filed 12 Jun. 2003 which designated the U.S. and claims benefit of DE 102 31 961.8, dated 15 Jul. 2002, the entire content of which is hereby incorporated by reference.

The invention relates to a low-height, dual or multiband antenna, in particular for motor vehicles, as claimed in the precharacterizing clause of claim 1.

The 900 MHz or the so-called 1800 MHz band is used for communication purposes, particularly in German and European mobile radio networks. The so-called 1900 MHz band is used for transmission, particularly in the USA. UMTS networks, which will be the next to appear, are designed to use the 2000 and 2100 MHz band ranges.

Low-height antennas are desirable in particular in the motor vehicle field and are intended to have electrical characteristics which are as good as possible, that is to say in particular a wide bandwidth, a good omnidirectional characteristic and a compact physical form.

Dual-band flat antennas have already been proposed on this basis and are also referred to, inter alia, as "stacked dual-frequency-microstripe" PIF antennas.

One such antenna which is known from the prior art has a flat antenna element which is parallel to a metallic base surface or base plate and is short-circuited on one of its longitudinal faces to the metallic base plate by means of a short circuit which runs at right angles to the flat antenna element and to the base plate. The length and width, and the size, of the flat antenna element are, by way of example, matched to the lowest frequency to be transmitted, for example to the 900 MHz band.

A flat antenna element based on a comparable principle is constructed on this basis, which is intended for transmission of a wider frequency band range, and is correspondingly physically smaller. It is seated with its longitudinal and transverse extent, which are shorter overall, with a further flat antenna element approximately centrally, in a plan view, on the physically larger flat antenna element located underneath it, to be precise likewise in a position parallel to it. On one of its longitudinal faces, preferably on the same longitudinal face as the flat antenna element for the lowest frequency band range, it is connected via a short circuit to the flat antenna element located underneath it. The short-circuiting element is preferably likewise once again aligned at right angles to the two flat antenna elements.

The feed is provided via a feed line which preferably runs at right angles to the flat antenna elements and is routed such that it runs essentially at right angles upward as far as the lower face of the topmost flat antenna element from a feed point, for example a matching network, in the area of the base plate, from which the feed point is isolated. For this purpose, an appropriate passage opening is provided in the flat antenna element located underneath it, in order to route the feed line as far as the topmost flat antenna element.

Although antennas such as these have in fact been proven in practice, the object of the present invention is to provide an improved flat antenna element whose production and assembly are considerably simpler than those for previous solutions. According to the invention, the object is achieved by the features specified in claim 1. Advantageous refinements of the invention are specified in the dependent claims.

The low-height dual or multiband antenna according to the invention is distinguished by its major parts being formed from a complete, integral stamped and bent part.

In other words, at least two flat antenna elements for transmission in two frequency bands as well as a short circuit which acts between them are produced and formed from a single stamped sheet-metal part.

In one preferred development of the invention, the corresponding short circuit for connection of the flat antenna element which is intended for the lowest frequency band range (that is to say that flat antenna element which is provided adjacent to the metallic base plate) is also a component of the entire integral stamped and bent part, that is to say it is a common component with the integral flat antenna.

A further preferred embodiment even provides for the feed line, which runs essentially at right angles to the flat antenna elements, likewise to be in the form of a stamped and bent part, to be precise as a part of the entire stamped and bent part.

The entire design can be cascaded a number of times, so that not only two but also at least three flat antenna elements are formed, which are of different sizes, are each arranged one above the other and run essentially parallel to one another, in order that the compact antenna can also transmit and receive, for example, as a multiband antenna in three band ranges.

Finally, it has also been shown that the dual or multiband antenna may have flat antenna elements which are not necessarily in each case formed at different heights to one another but at the same height, with the short circuit between two flat antenna elements in this case then likewise being arranged such that it runs at the same height level.

The flat antenna elements can essentially be provided with parallel and vertical cut edges and bending edges in a plan view. However, it is just as possible for the stamped edges, which in each case point outwards, of the higher flat elements for transmission in the higher frequency band range to be designed, for example, such that they run diverging slightly outwards from their short-circuit links toward their free end, or such that they converge inward, or to have obliquely running end edge areas in particular at their free end. The stamped edges of the lower-level flat elements can likewise be designed such that they run obliquely, in which case the stamped edges on the outside and inside need not necessarily run parallel.

Another preferred development of the invention furthermore makes it possible to provide for the antenna vanes to be lengthened downwards by a further bend.

In addition, the short-circuit connections need not be formed over the entire width of the respective flat element, but may be shorter than the adjacent transverse extent of the respective flat element.

Figure 2:
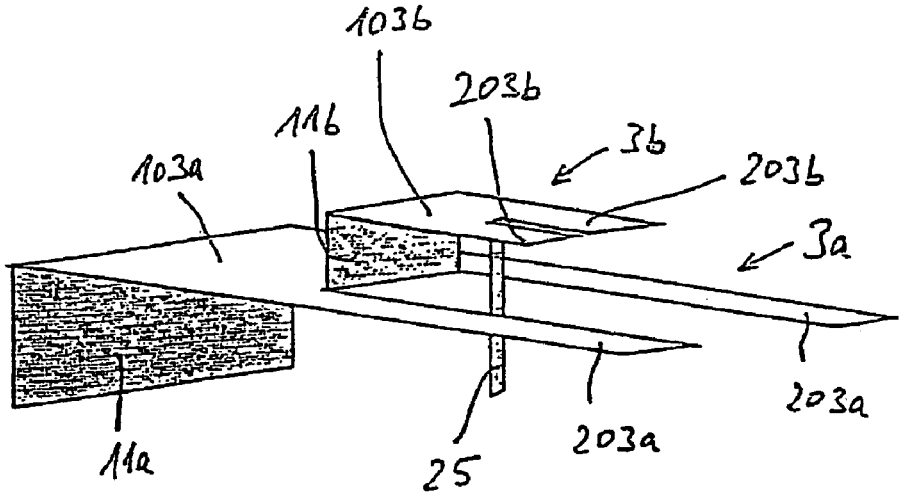
Figure 3:
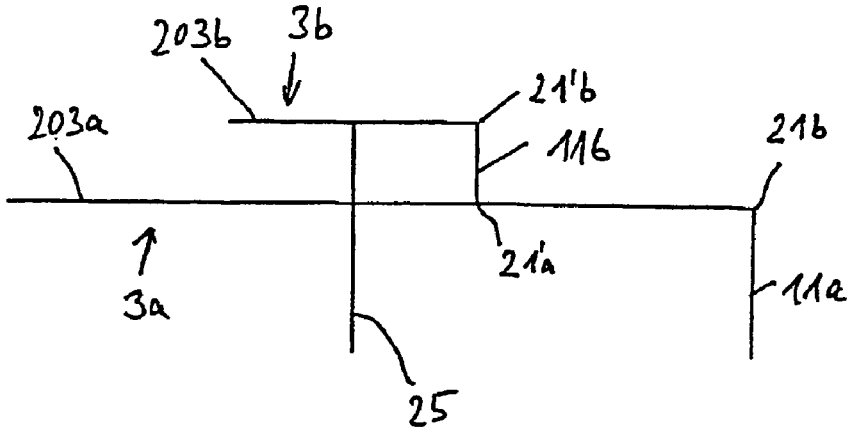
Figure 4:
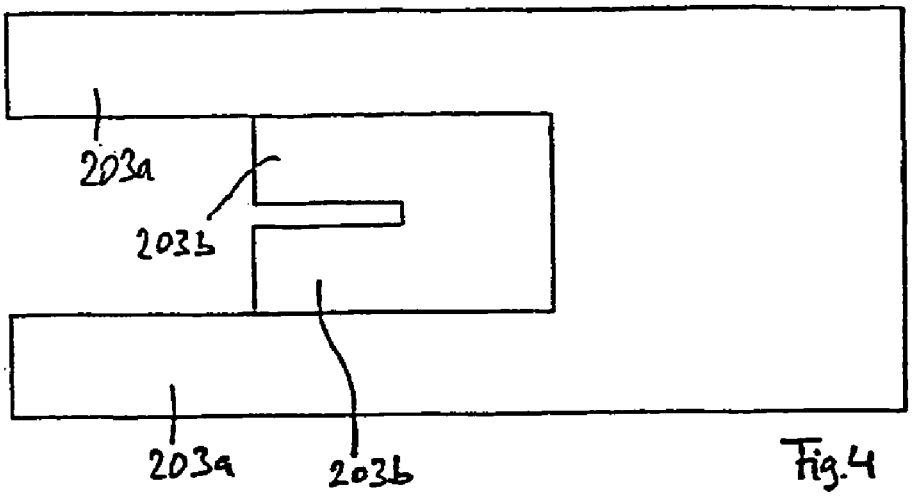
Figure 5:
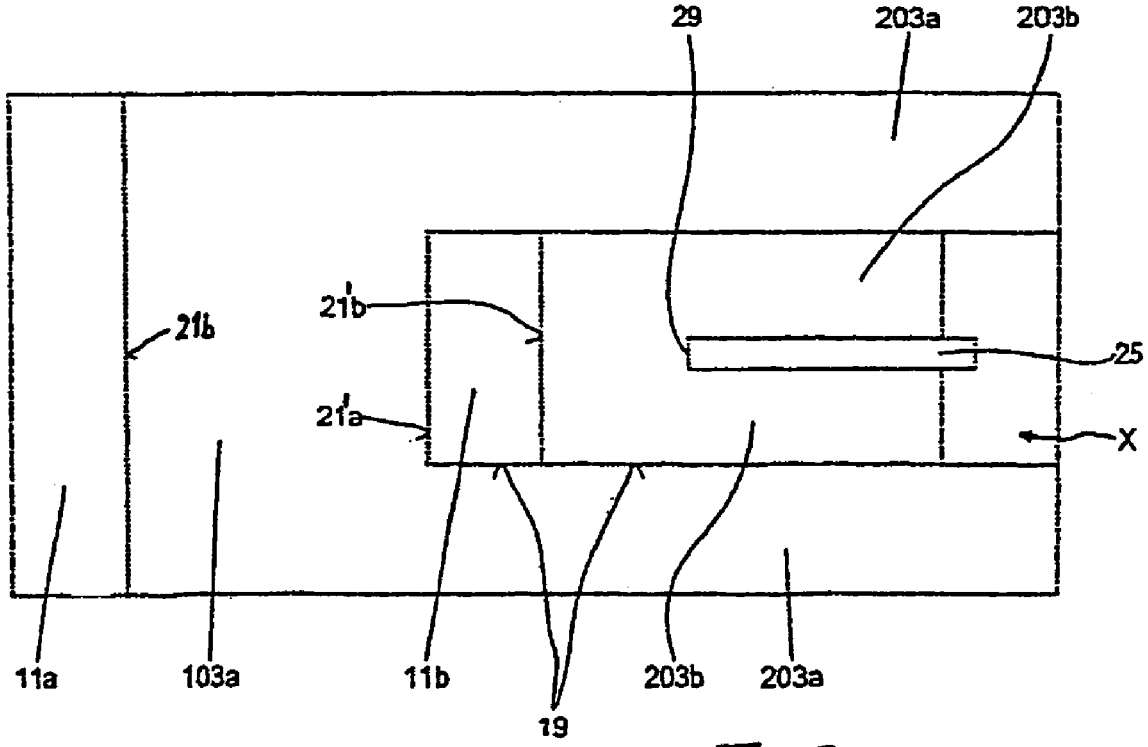
Figure 6:
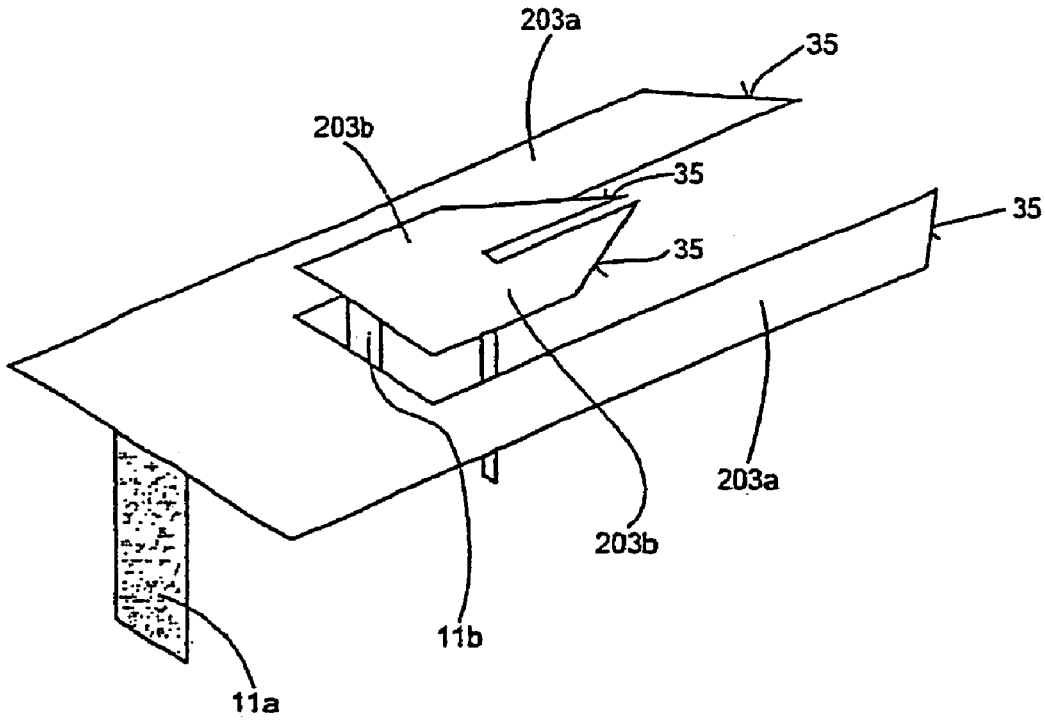
Figure 7:
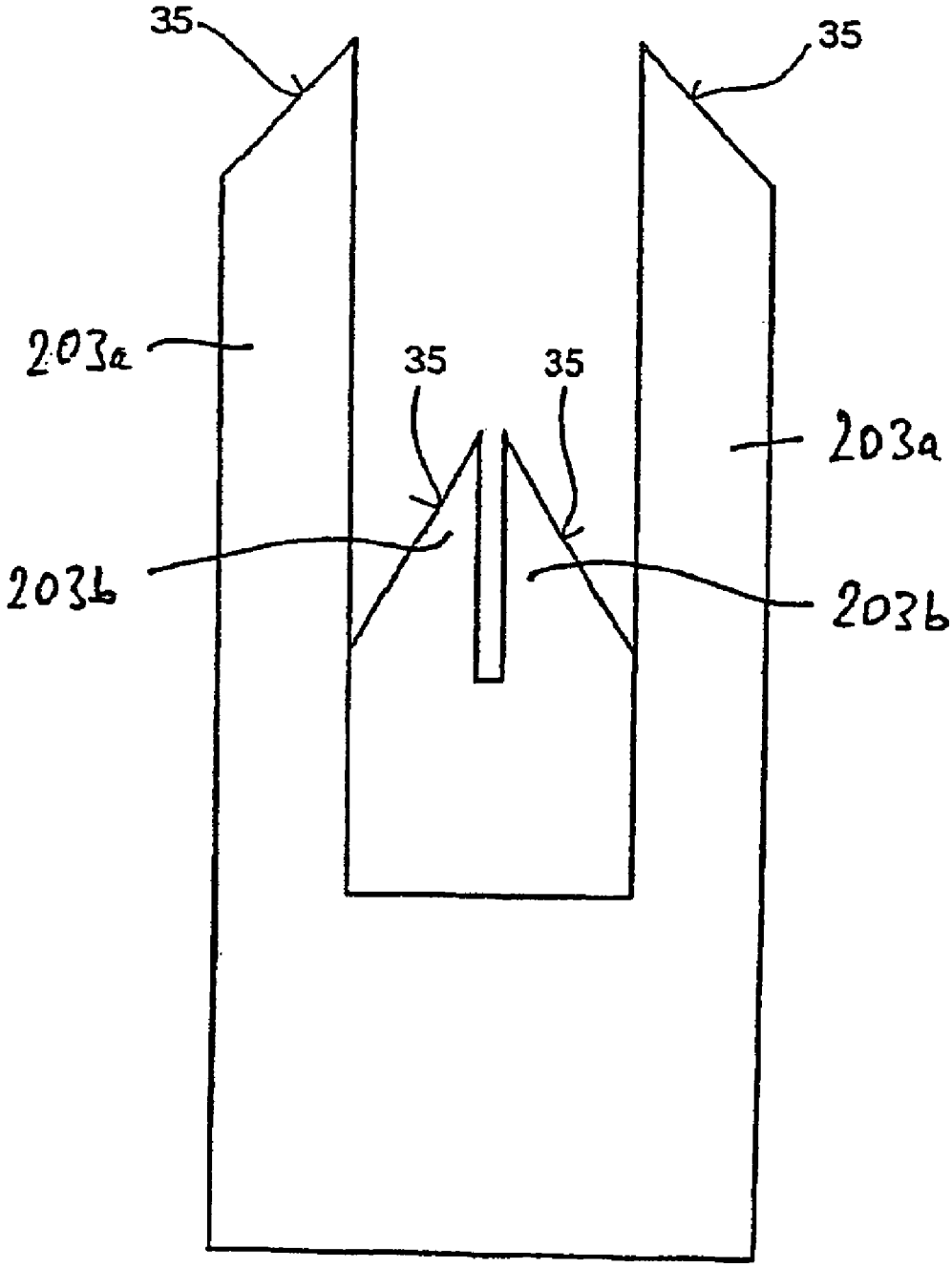
Figure 8:
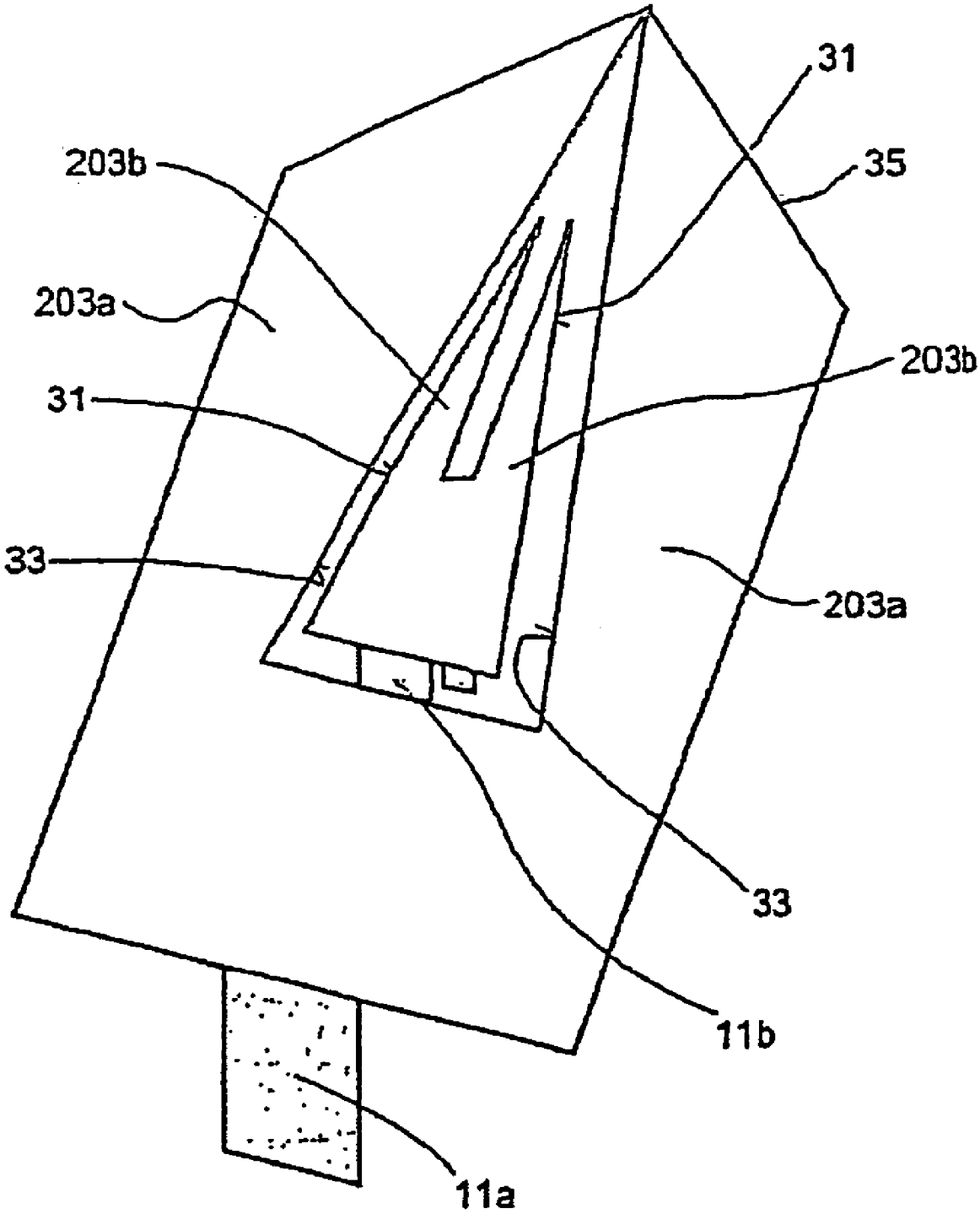
Figure 9:
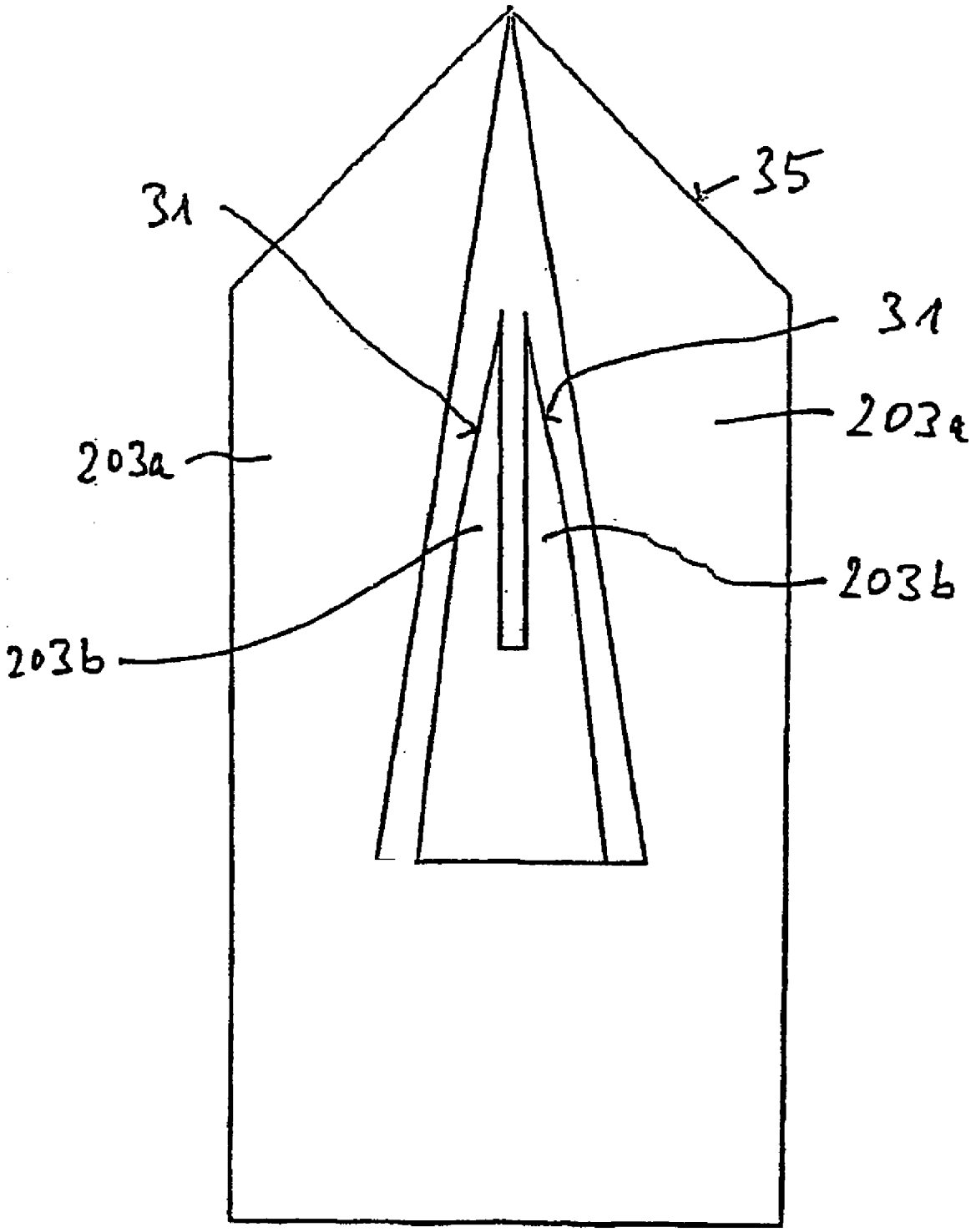
Figure 10:
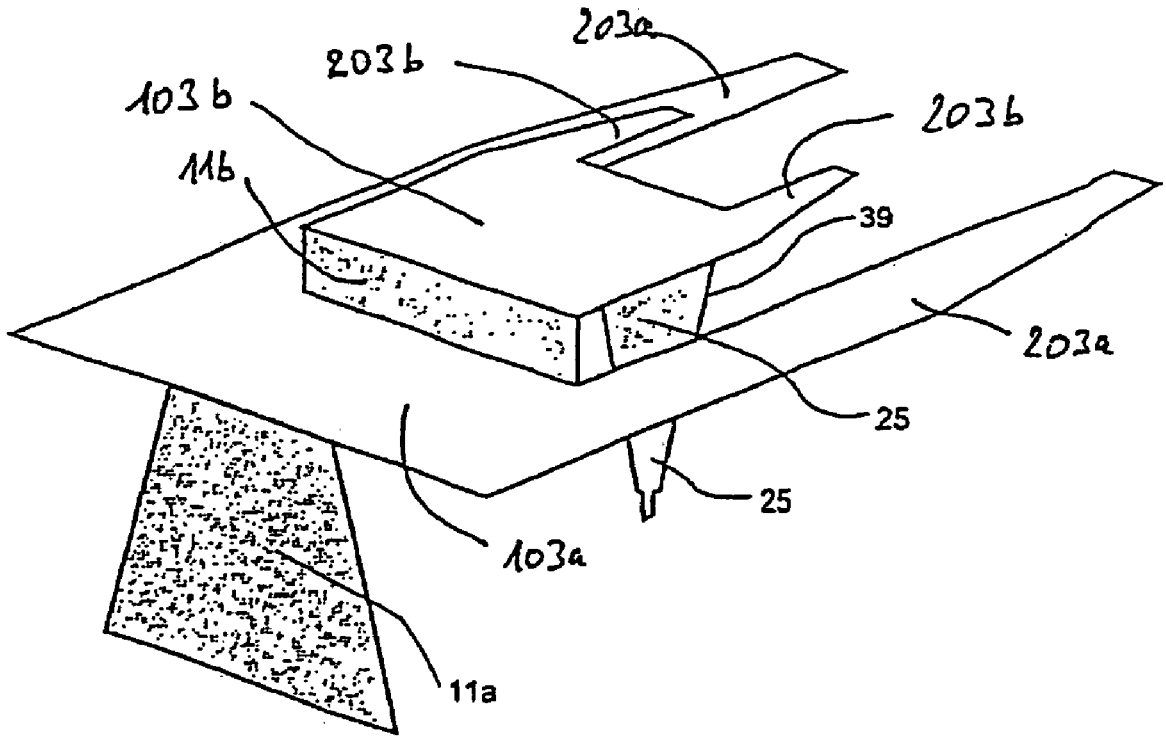
Figure 11:
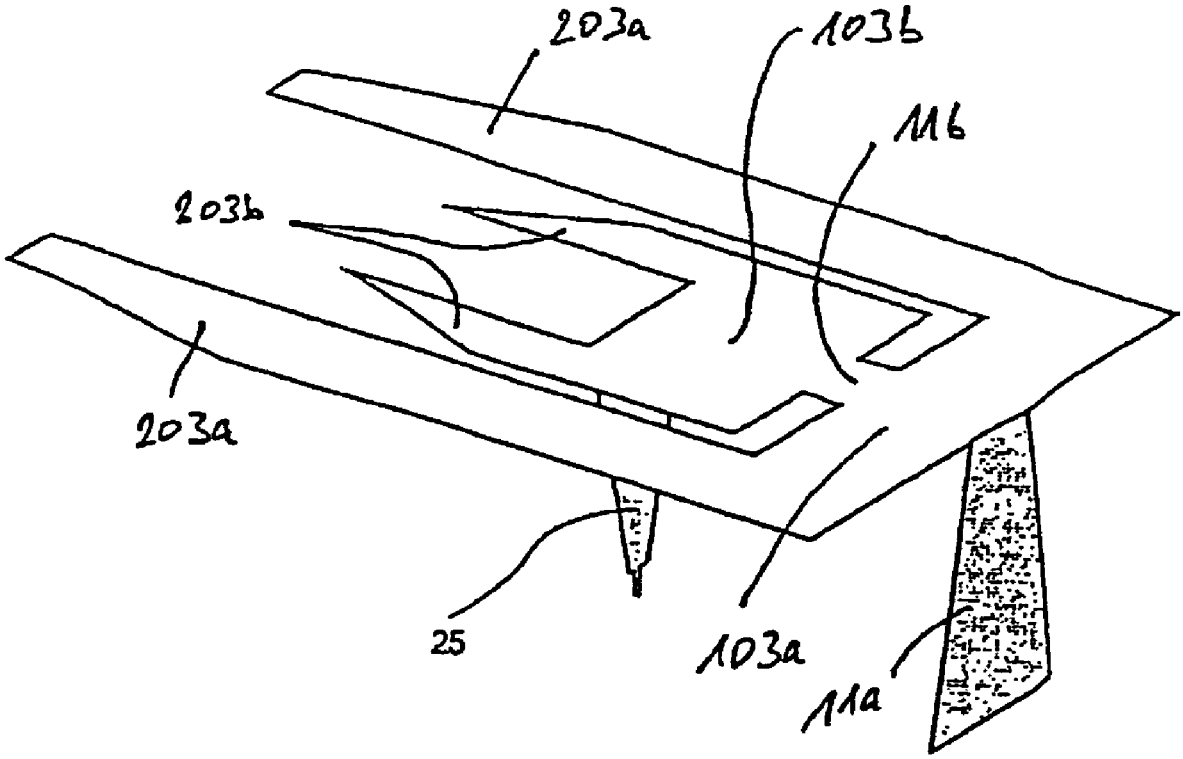
Figure 12:
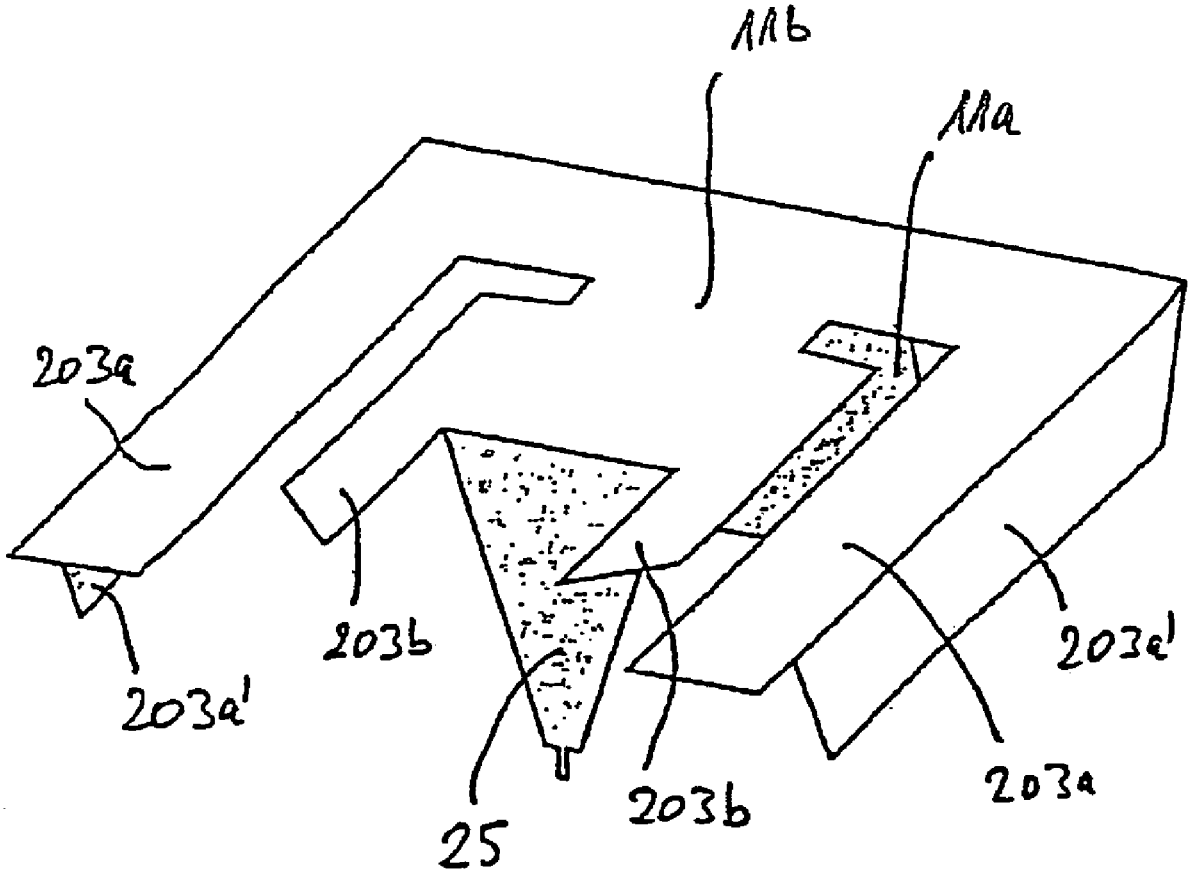
Figure 13:
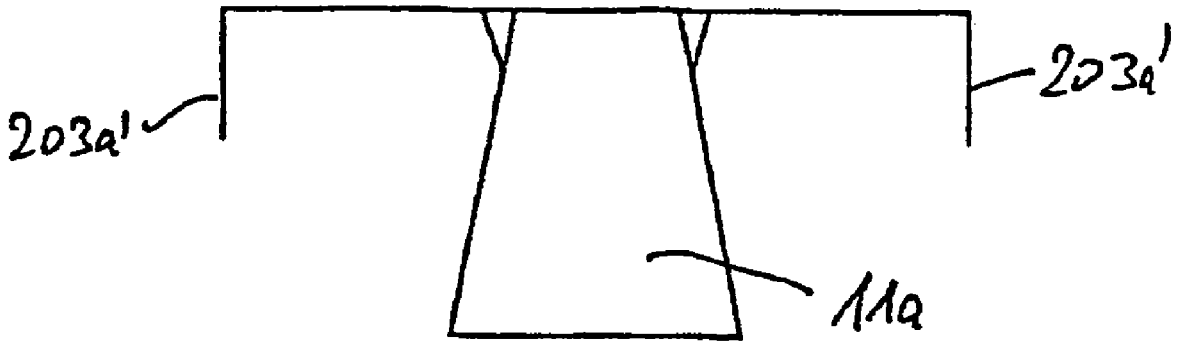
Figure 14:
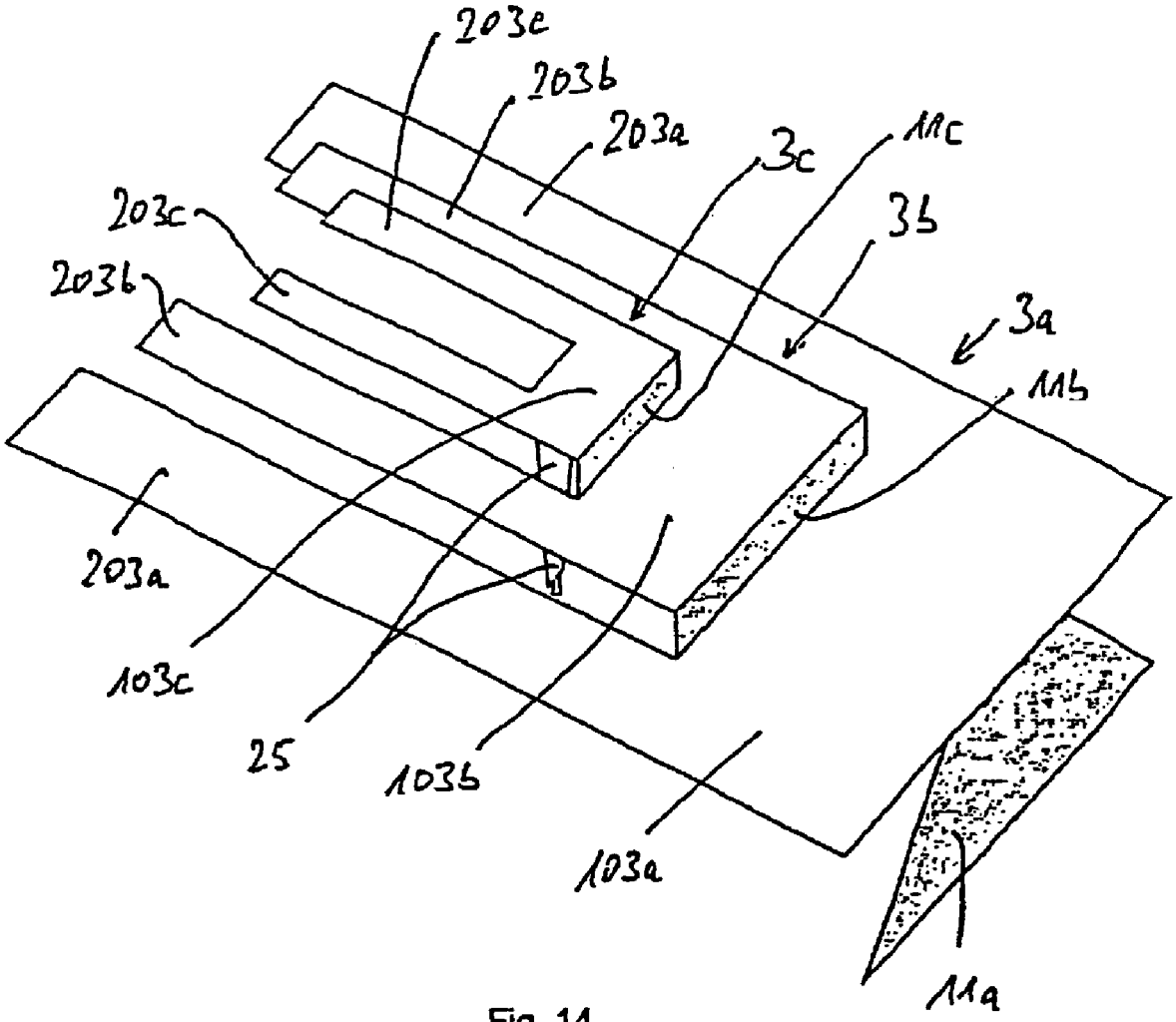
Figure 15:
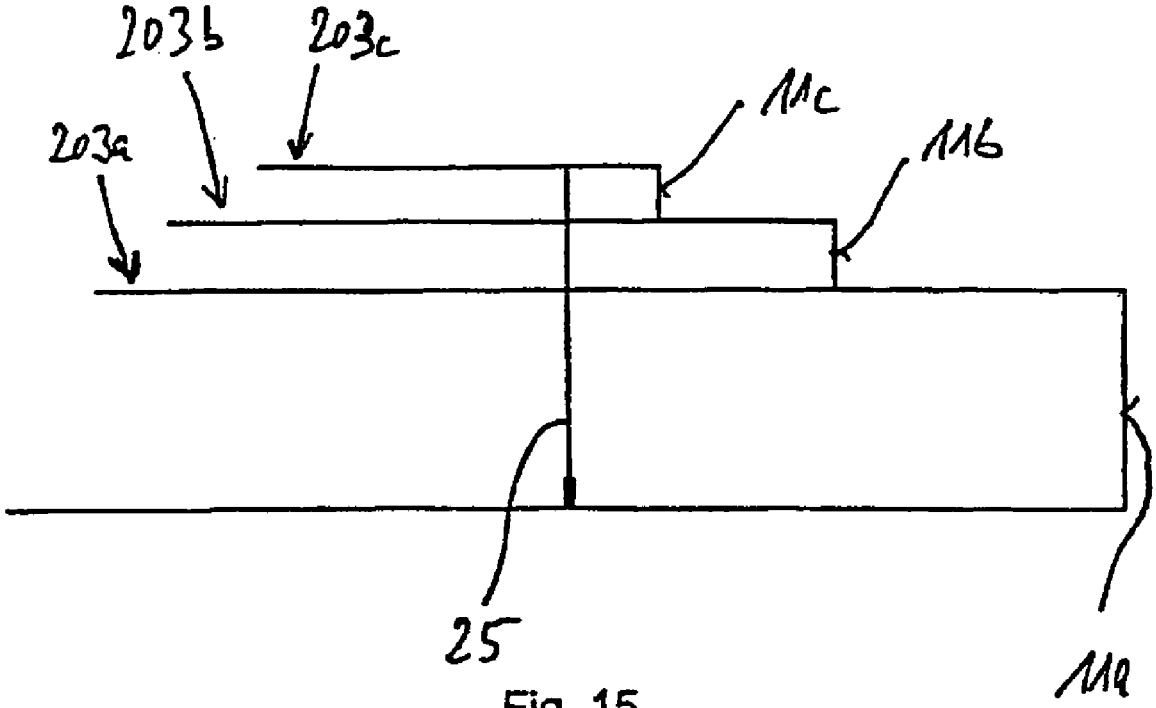

The invention will be explained in more detail in the following text with reference to drawings in which, in detail:

FIG. 1: shows a first perspective view of a first dual-band antenna;

FIG. 2: shows another perspective illustration of the dual-band antenna illustrated in FIG. 1;

FIG. 3: shows a corresponding rearward side view of the flat antenna illustrated in FIGS. 1 and 2;

FIG. 4: shows a corresponding plan view of the flat antenna shown in FIGS. 1 to 3;

FIG. 5: shows a plan view of a metallic blank plate (metal sheet) on which the stamping and bending lines for production of an antenna in FIGS. 1 to 4 are shown;

FIG. 6: shows an exemplary embodiment of a corresponding flat antenna, modified from that shown in FIG. 1;

FIG. 7: shows a plan view of the exemplary embodiment shown in FIG. 6;

FIG. 8: shows a perspective illustration of another modified exemplary embodiment of a flat antenna;

FIG. 9: shows a plan view of the illustration shown in FIG. 8;

FIG. 10: shows a perspective illustration of another modified exemplary embodiment;

FIG. 11: shows a further exemplary embodiment of a dual-band antenna with antenna surfaces at the same height;

FIG. 12: shows a perspective illustration of a further exemplary embodiment with antenna vanes which have been lengthened downwards;

FIG. 13: shows a rearward side view of the illustration shown in FIG. 12;

FIG. 14: shows a perspective illustration of a further exemplary embodiment of a triband antenna; and FIG. 15: shows a side view of the exemplary embodiment shown in FIG. 14.

FIGS. 1 to 4 show a first exemplary embodiment of a low-height compact dual-band antenna according to the invention, which comprises two flat antenna elements 3*a* and 3*b* which are arranged parallel to one another. An antenna element such as this is normally provided with a larger metallic surface or base plate 7, that is to say it is connected to it, or a corresponding antenna is, for example, when used on a motor vehicle, fitted at an appropriate point on the sheet-metal bodywork of the vehicle, which is then used as the metallic opposing surface or base surface.

The lower flat element or the lower flat antenna element 3*a* is tuned for transmission in a lower or low frequency band, for example in the 900 MHz band range. The physically smaller flat antenna element 3*b* which is constructed above this is, for example, tuned for transmission in the region of the 1800 MHz band range.

The upper flat antenna element 3*b* is connected on its narrower boundary face or edge 9*b*, which is located on the left in FIG. 1, via a short circuit 11*b* to the physically larger flat antenna element 3*a* located underneath it, with the short circuit 11*b* in the illustrated exemplary embodiment having a width which corresponds to the width of the upper flat antenna element 3*b*.

The lower flat antenna element 3*a* is likewise equipped on its narrower boundary face 9*a*, which is located on the left, with a vertical short-circuiting surface 11*a*, via which an electrical connection is normally produced to the electrical base surface or base plate 7 that has been mentioned.

Finally, the upper and the lower flat antenna elements are each equipped such that a part of the respective flat antenna element comprises a closed metal surface section 130*a* or 130*b*, to which two antenna vanes 203*a* and 203*b*, respectively, which are offset in the transverse direction of the antenna element, are then connected on the respective opposite face to the short circuit 11*a* or 11*b*.

In the illustrated exemplary embodiment, the entire antenna that is shown in FIG. 1 is produced from a single stamped and bent part, with the exception of the base plate 7. In this context, FIG. 5 shows a metallic blank metal sheet in which the corresponding stamping lines 19 are shown by dashed-dotted lines, with the bending edge 20 being shown by a dotted line. The flat antenna element 3*b* for the respective higher frequency band range can then be positioned higher than and parallel to the flat antenna element 3*a* located underneath it by means of the stamping and cutting process and by subsequently bending along the bending edges 21'*a* and 21'*b*, as can be seen from FIGS. 3*a* and 3*b*. The bending process in this case results in the short circuits 11*a* and 11*b* being positioned at right angles to the plane of the flat antenna elements.

The plan view of the blank sheet-metal part shown in FIG. 5 in this case shows that, in this exemplary embodiment, only the material area identified by x need be cut out and removed during the stamping process. The remaining parts are just stamped and/or folded and bent on the corresponding lines in order then to produce the dual-band antenna illustrated in FIGS. 1 to 4.

Finally, a feed line 25 is also required, which is preferably provided at right angles to the plane of the flat antenna elements and is routed from underneath up to the lower face of the flat antenna element 3*b* above it. In the illustrated exemplary embodiment, this feed line 25 is likewise produced as a stamped and bent part, for which purpose the uppermost flat antenna element 3*b* has a recess 27 in the form of a slot, to be precise extending from a bending edge 29 which is formed at the left of the end of the recess 27 which is in the form of a slot, thus making it possible to bend a narrow metal strip at right angles downward in order to form the feed line 25 that has been mentioned.

In the exemplary embodiment shown in FIGS. 1 to 4, the blank material, which is in the form of a plate, is thus used virtually completely, since the flat antenna element which is located between the outer side edges 31 of the upper flat antenna element 3*b* and the inner side edges 33 of the flat antenna element located underneath it is formed just by means of a stamping or cutting line 19 without having to cut out the material. In the exemplary embodiment shown in FIGS. 6 and 7, in contrast, a respective short circuit 11*a* or 11*b* is made narrower in the transverse direction of the flat antenna elements, so that corresponding material areas have to be stamped out of a blank metal plate while carrying out the stamping and bending process.

Furthermore, the front ends of the antenna vanes 203*a* and 203*b* are not provided at their free end with end or cut edges 35 which run at right angles to the longitudinal extent of the antenna vanes, but with end or cut edges 35 which run toward one another obliquely from the outside inward, that is to say they converge.

In the exemplary embodiment shown in FIGS. 8 and 9, the outer cut edges 31 of the respective higher flat antenna element converge from the short-circuit face toward the free end, and in this case are parallel to the correspondingly converging inner cut edges 33 of the lower flat antenna element 3*a*. This results in antenna vanes 203*b* which run to a point, at least for the higher flat antenna element 3*b*. The antenna vanes 203*a* of the lower flat antenna element have a width and extent which increase towards their free end. The outer end or cut edge can likewise be designed such that it converges again, in which case the front end tips of the antenna vanes 203*a* of the lower flat antenna element can then touch one another, or virtually touch one another.

In the exemplary embodiment shown in FIG. 10, the piece of feed line, which is likewise produced as a stamped or bent part, is likewise formed from the top downwards as an increasingly narrower metal strip, that is to say as a metal strip with stamped edges 39 which run toward one another, converge and are on opposite sides. Conversely, the short circuit 11*a* has a trapezoidal shape running from the bottom upwards, at least with respect to the flat antenna element for the lower frequency band range. Finally, the exemplary embodiment illustrated in FIG. 11 shows that the antenna surfaces as well as the antenna vanes for the various frequency band ranges may also be arranged at the same height level, that is to say arranged in an O-shape or in the form of a fork, so that, in this exemplary embodiment as well, the short circuit 11*b* which connects the two flat antenna elements 11*b* and 11*a* is located in an arrangement at the same height.

A multiband antenna can also be designed in a corresponding manner to the explained exemplary embodiment, specifically by adding a third flat antenna element, for example, to the corresponding cascading of the two flat antenna elements as explained in the drawings, which third flat antenna element is physically smaller and is formed in a corresponding repetitive manner on the second flat antenna element. In this case as well, the complete antenna formed in this way may be produced as a single stamped and bent part, that is to say it may be integral.

The following text refers to the exemplary embodiment shown in FIGS. 12 and 13. In this exemplary embodiment, the antenna element vanes 203*a* of the lowermost flat antenna element are provided with antenna vane sections 203*a*' which have been lengthened downwards, thus resulting in the advantage that the antenna vanes 203*a* can be shortened overall in comparison to other exemplary embodiments and, at the same time, are mechanically more robust. In the illustrated exemplary embodiment, the corresponding antenna vane sections 203*a*' are in this case formed with bent metal sections, which project vertically downward, on the outer edge of the antenna vanes.

If specified appropriately, antenna vane sections such as these may also alternatively or additionally be provided on an antenna vane 203*b* on a flat antenna element 3*b* for transmission in a higher frequency band.

FIGS. 14 and 15 illustrate a corresponding antenna type, which is suitable for transmission and reception in three bands which are offset with respect to one another. The corresponding design of the flat antenna element 3*b* in this exemplary embodiment is effectively cascaded once again, in comparison to the previous exemplary embodiments, by the addition of a physically smaller flat antenna element 3*c* located above it, which likewise once again has corresponding antenna element vanes 303*a*. The connection to the antenna element 3*b* located underneath it is likewise made via a corresponding short circuit 11*c*. The feed is provided via a feed line 25, which leads to the uppermost flat antenna element 3*c*.

The antennas which have been explained are so-called PIF antennas, that is to say so-called "planar inverted F antennas". In this case, it is known that the characteristics of the respective antenna can be influenced in the case of antennas such as these by the configuration and the location of the feed point and of the short circuits. The characteristics of the antennas can thus be individually matched to the influences of the respective vehicle bodywork and the respective installation location by the configuration and the location of the feed point and of the short circuits. In this case, the short circuits, for example the short circuits 11*a* and 11*b*, are generally each located on the narrow face of the antenna arrangement, which is preferably basically longitudinally symmetrical (that is to say symmetrical with respect to a vertical central longitudinal plane). The feed point for the antenna is preferably provided on this longitudinal line of symmetry or longitudinal plane of symmetry of the antenna. The antenna impedance, which should normally be 50 Ohms for car radio antennas, can also be matched by the position of the feed point and its distance from the short circuit.

The invention claimed is:

1. A low-height multiband antenna disposed on a metallic base surface, the antenna comprising at least first and second substantially flat antenna elements for respectively operating on first and second frequency bands that are offset with respect to one another, the first and second flat antenna elements being aligned to be substantially parallel to one another, one of the first and second antenna elements being disposed closer to the base surface than the other of the first and second antenna elements, the first and second antenna elements having different sizes, the first flat antenna element being dimensioned for transmission in a first frequency band range, the second flat antenna element being dimensioned for transmission in a second frequency band range lower than said first frequency band range, at least one short circuit provided between said at least first and second flat antenna elements the first flat antenna element being short-circuited via the short circuit to the second flat antenna element, and the second flat antenna element being connected via a short circuit to the metallic base surface, the multiband antenna being formed as an integral metal part, the multiband antenna having, as an integral component, at least said first and second flat antenna elements and the short circuit provided between said at least first and second flat antenna elements, at least one of the first and second flat antenna elements having adjacent thereto, plural antenna element surface antenna element vanes which are electrically connected to associated antenna element surfaces, the first flat antenna element being disposed between said plural antenna element vanes in a plan view of the antenna, the first and second flat antenna element being arranged to be substantially coplanar; and an integrally connected feed line a coupled to said first and second flat antenna elements.

2. The antenna as claimed in claim 1, wherein the electrical short circuit which connects the first and second flat antenna elements is connected to the two flat antenna elements via opposed bending edges.

3. The antenna as claimed in claim 1, wherein the second flat antenna element is arranged beneath the first antenna element and is provided with a short circuit which forms a part of the antenna and is connected via a bending line to the antenna element surfaces thereof.

4. The antenna as claimed in claim 1, wherein the second flat antenna element has a recess in the form of a slot thereby forming a feed line, which is curved downward over a bending line, substantially at right angles to the plane of the second flat antenna element.

5. The antenna as claimed in claim 1, wherein the antenna vanes have end edges that run at right angles to longitudinal edges thereof.

6. The antenna as claimed in claim 1, wherein the antenna vanes have end edges that are aligned such that they converge from the outer edges toward the center.

7. The antenna as claimed in claim 1, wherein the antenna vanes have outwardly pointing side edges provided with a short circuit such that they converge toward their free end.

8. The antenna as claimed in claim 1, wherein the antenna vanes have stamped, inwardly pointing edges provided for the lower transmission ranges run from their short-circuit face such that they converge toward their free end.

9. The antenna as claimed in claim 1, wherein said at least one short circuits has a rectangular shape and extends over the entire width of an associated antenna element.

10. The antenna as claimed in claim 1, wherein the at least one short circuit is shorter than the widths of the first and second antenna elements.

11. The antenna as claimed in claim 10, wherein the short circuits have a triangular shape.

12. The antenna as claimed in claim 1, wherein the antenna vanes are arranged at different height levels, with the first flat antenna element being arranged above the second antenna element.

13. The antenna as claimed in claim 1, wherein the at least first and second flat antenna elements are arranged with their antenna vanes at the same height level.

14. The antenna as claimed in claim 1, wherein the antenna element vanes are provided on their boundary edge which points outward with antenna vane sections which are preferably aligned such that they point downward.

15. The antenna as claimed in claim 1, wherein the antenna comprises a triband antenna and further comprises a third, cascaded flat antenna element shaped like the first and second flat antenna elements that is matched for transmission in higher frequency band range higher than said second band.

16. An integrally formed multiband antenna comprising:

a conductive base;

a first substantially planar antenna element for operation at a first frequency band;

a second substantially planer antenna element for operation at a second frequency band different from the first frequency band, the second antenna element being substantially parallelly aligned with said first antenna element;

a first short-circuit that short-circuits a portion of said first antenna element to a portion of said second antenna element;

a second short-circuit that short-circuits a portion of said second antenna element to said conductive base;

at least first and second surface antenna element vanes electrically connected to said antenna element surfaces, at least one of said first and second antenna elements being disposed between said first and second vanes; and an integral feed line coupled to said first and second antenna elements, wherein at least said conductive base, first antenna element, and second antenna element are formed by cutting and bending a common sheet of conductive material.

* * * * *